United States Patent [19]

Van Der Molen

[11] Patent Number: 4,865,034

[45] Date of Patent: Sep. 12, 1989

[54] DEPILATING APPARATUS

[75] Inventor: Jacobus H. Van Der Molen, Drachten, Netherlands

[73] Assignee: U.S. Philips Corp., New York, N.Y.

[21] Appl. No.: 127,833

[22] Filed: Dec. 2, 1987

[30] Foreign Application Priority Data

Dec. 3, 1986 [NL] Netherlands ..... 8603077

[51] Int. Cl.[4] ..... A61B 17/00

[52] U.S. Cl. ..... 128/355; 222/146.5; 401/1; 401/143; 401/179; 604/291

[58] Field of Search ..... 604/289, 290, 291, 310, 604/311; 128/355; 401/1, 2, 143, 171, 179, 181; 222/146.2, 146.5

[56] References Cited

U.S. PATENT DOCUMENTS

| | | | |
|---|---|---|---|
| 861,802 | 7/1907 | Brown | 401/179 |
| 1,306,830 | 6/1919 | Moore | 401/143 |
| 3,032,801 | 5/1962 | Alexander | 401/179 |
| 3,858,785 | 1/1975 | Fiveash | 128/355 |
| 4,379,220 | 4/1983 | Middleman et el. | 119/5 |
| 4,465,073 | 8/1984 | Schwob | 128/355 |

FOREIGN PATENT DOCUMENTS

| | | | |
|---|---|---|---|
| 2113994 | 8/1983 | United Kingdom | 401/1 |

*Primary Examiner*—C. Fred Rosenbaum
*Assistant Examiner*—Mario Costantino
*Attorney, Agent, or Firm*—Ernestine C. Bartlett

[57] ABSTRACT

The invention relates to a depilating apparatus of the type with which the fluid wax is provided on the skin, the wax after solidification being removed together with the hairs, the apparatus comprising a housing having a reservoir for the wax, the reservoir communicating with an outflow aperture in the wall of the housing. The housing also comprises structure to heat the wax and to transport the wax from the reservoir to the outflow aperture.

5 Claims, 3 Drawing Sheets

DEPILATING APPARATUS

FIELD OF THE INVENTION

The invention relates to a depilating apparatus of the type with which fluid wax is provided on the skin, the wax, after solidification, being removed together with the hairs, the apparatus comprising a housing having a reservoir for the wax, said reservoir communicating with an outflow aperture in the wall of the housing.

BACKGROUND OF THE INVENTION

Such a depilating apparatus is known from Netherlands Patent Application No. 8204443. In this apparatus it is necessary to place the apparatus, before use, in a separate holder having a heating element so as to bring the wax to the required temperature. During use of the apparatus the wax will gradually lose its fluid properties as a result of cooling.

A roller for distributing the wax is placed in the outflow apparatus of said known apparatus. This requires a great extent of fluidity of the wax, which means a comparatively high temperature and hence a comparatively long warming up time. Moreover it may be painful when the wax is provided on the skin.

SUMMARY OF THE INVENTION

It is the object of the invention to avoid these disadvantages and the invention is characterized in that the housing also comprises means for heating the wax and for transporting the wax from the reservoir to the outflow aperture.

The means for heating the wax may now be placed in the immediate proximity of the reservoir as a result of which optimum heat transfer can be obtained. When the means for heating are switched off during use, the cooling of the wax is nevertheless delayed by the heat contents of the said means. As a result of the presence of the transporting means the wax may have a greater viscosity and hence a lower temperature than when the wax must flow out of the reservoir under the influence of gravity.

In a preferred embodiment of the invention, the housing of the apparatus contains a heating element such as a conventional PTC heating element. Moreover, the reservoir for the wax may have a movable wall part which has an operating member projecting partly beyond the housing.

In an especially preferred embodiment, the movable wall part is journalled in the housing so as to be rotatable by means of bearing means and is situated opposite to a bottom of the reservoir and the movable wall part comprises a first operating member which is situated near the outflow aperture and with which the wall part can be moved towards the bottom against the resilient force, the bearing means being situated on the side of the reservoir remote from the outflow aperture and comprising a second operating member by means of which the bearing means and the movable wall part can also be moved with respect to the bottom of the reservoir.

The outflow aperture may also form a filling aperture for the reservoir, a wall part of the housing adjoining the aperture being pivotably connected to the housing.

The wax may be contained as a foil of packaged wax. Preferably the apparatus housing, at the area of the outflow aperture, comprises a mount that has an aperture which corresponds to the outflow aperture and the mount engages, preferably in clamping fashion, ends of foil containing the wax and projecting beyond the outflow aperture. In order to simplify the maintenance of the apparatus, it is of importance to prevent the wax from contaminating the apparatus. Moreover, it is desirable for the operation of the transporting means of the wax that said structural components cannot directly contact the wax.

For this purpose it is of particular advantage to use in the apparatus according to the invention a quantity of wax which is packaged in a plastic foil.

Preferably, the wax is packaged substantially in a flat shape between two foil parts having a detachable seam, which seam most preferably comprises an end that may be seized by the hand.

Besides avoiding contamination of the interior of the apparatus it is achieved that the correct quantity of wax is always stored in the apparatus. The packaged quantity of wax may have a flat shape and as a result of the flexible foil it can readily adapt itself to the shape of the reservoir, which helps to facilitate favorable heat transfer. Several quantities of wax, for example, in strip form, can be taken along in a simple manner.

BRIEF DESCRIPTION OF THE DRAWINGS

The invention will now be described in greater detail with reference to a description of an embodiment shown in the Figures.

DETAILED DESCRIPTION OF PREFERRED EMBODIMENTS

Figure 1:
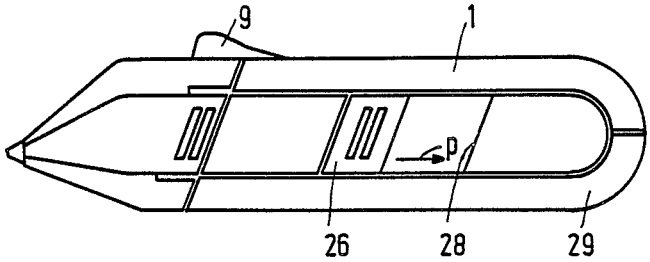
FIG. 1 is a side elevation of the depilating apparatus.
Figure 2:
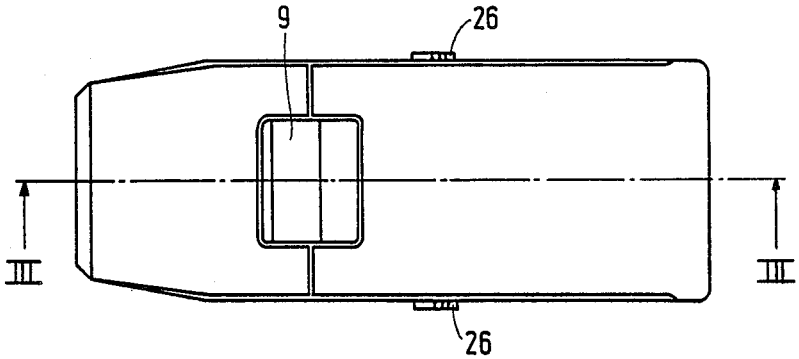
FIG. 2 is a plan view of the depilating apparatus shown in FIG. 1.

The depilating apparatus shown in the Figures comprises a housing 1 having an outflow aperture 2 and a reservoir 3 for the wax, which reservoir communicates with the outflow aperture 2. The housing also comprises an electric heating element 4 which is in heat transferring contact with the reservoir 3. The heating element 4 is preferably equipped with an element having a positive temperature coefficient of electrical resistance, commonly referred to in the art as PTC-elements so that separate members for controlling the temperature of the apparatus are superfluous. Via the contact pins 6 and a cable not shown the apparatus may be connected to a known electric supply source, for example, the mains.

The reservoir 3 for the wax comprises a movable wall part 7 and an operating member 9 bearing on the wall part via the plate 8. The plate 8 is connected to the housing 1 so as to be rotatable by means of the pivot 10. As will be explained hereinafter, the movable wall part 7 is connected to the shaft 11 in the reservoir so as to be rotatable.

Figure 3:
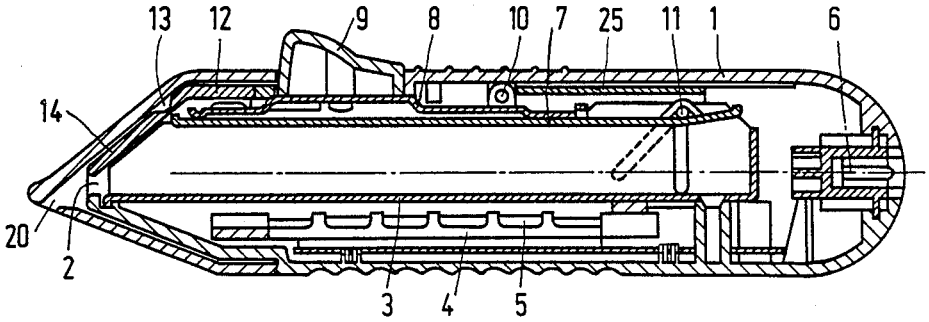
FIG. 3 is a sectional view taken on the line III—III in FIG. 2.
Figure 5:
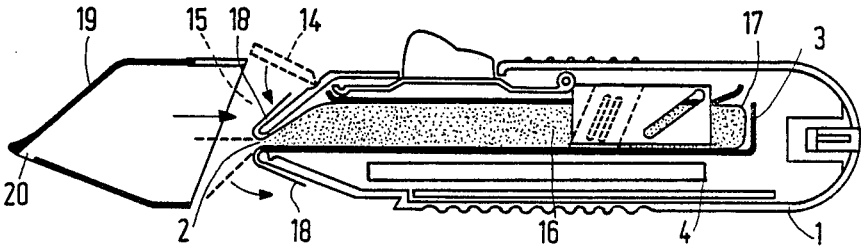
FIGS. 5 to 8 are simplified sectional views in accordance with FIG. 3 of the depilating apparatus showing different positions of the adjustable members of the apparatus.

The housing 1 comprises an insert 12 having a restriction 13. As a result of this the wall part 14 can pivot around the restriction 13 and the outflow aperture 2 can be enlarged to the filling aperture 15. The wall part 14 is then raised as is shown in broken lines in FIG. 5. In this position a quantity of wax can be provided in the reservoir via the filling aperture 15. FIG. 5 shows the situation in which a quantity of wax 16 is present in the reservoir 3. The wax is packaged in plastic foil 17 the ends 18 of which project beyond the outflow aperture 2 and are folded back along the wall of the housing. At the area of the outflow aperture 2 the housing comprises a mount 19 having an aperture 20 corresponding to the outflow aperture. By means of the mount 19 which in the assembled condition engages the housing 1 (see, for example, FIG. 3) the ends 18 of the foil can be clamped between the housing 1 and the mount 19.

Figure 4:
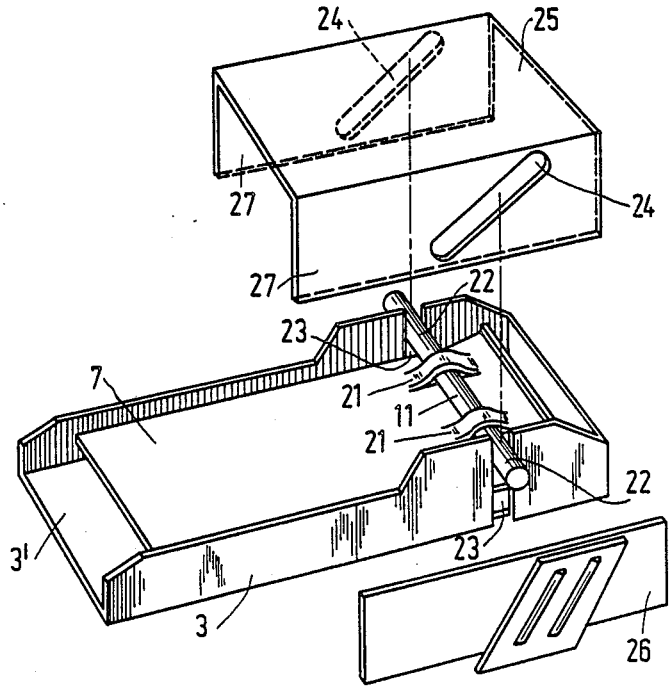
FIG. 4 shows a few components of the apparatus of FIGS. 1 to 3 in a dismantled state.
Figure 6:
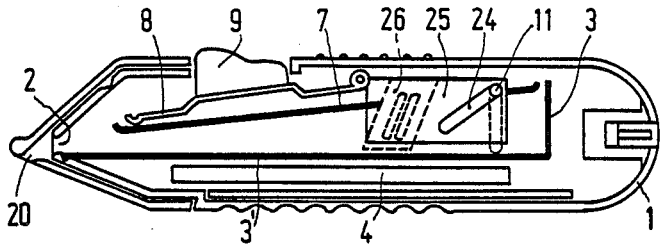
Figure 7:
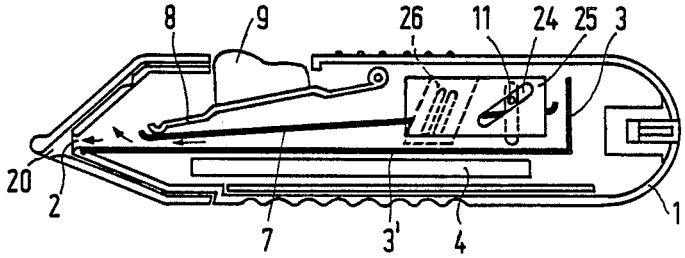

When the wax in the reservoir 3 has become fluid by means of heating element 4, the movable wall part 7 can be pressed inwards via the plate 8 by operating the button 9 (FIG. 6) as a result of which the wax is compressed and can be provided on the skin via the outflow apertures (2 and 20). Because in this manner pressure can be exerted only on the wax in the part of reservoir 3 which adjoins the outflow aperture 2, measures have been taken to be able to force the wax out of the apparatus at the end of the reservoir remote from the outflow aperture. The components required for this purpose are shown in the exploded view of FIG. 4. The movable wall part 7 comprises a shaft 11 which is retained by members 21 forced out of the plane of the wall part 7. The ends 22 of the shaft 11 are situated in the slots 23 of the wax reservoir 3 and also project through the inclined slots 24 of the adjusting member 25 when this has been placed over the wax reservoir 3 in the mounted position (see also FIG. 3). The adjusting member 25 comprises on each side a second operating member 26 of which only one is shown in FIG. 4 to avoid complexity of the drawing. These operating members 26 are rigidly connected to the walls 27 of the adjusting member 25. Each operating member is journalled in an aperture 28 in a side wall 29 of the housing 1 and can be moved in the direction of the arrow P (FIG. 1). By moving in the direction of the arrow P the operating members 26 can be moved into two different positions so that the position of adjusting member 25 is also varied with respect to the wax reservoir 3. For example, by a first movement the situation as shown in FIG. 7 is achieved in which the shaft 11 and hence the movable wall part 7 is situated nearer to the bottom 3' of the wax reservoir 3 as a result of the inclination of the slots 24. As a result of this the wax which is present in the end of the wax reservoir remote from the outflow aperture 2 is moved towards the outflow aperture. For further transport via the outflow aperture 2 to the exterior the operating member 9 may be actuated again.

Figure 8:
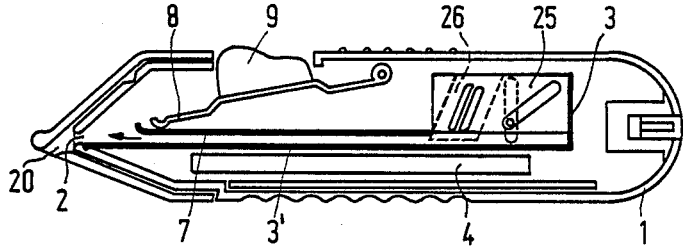

This process can be repeated by moving the operating members to a third position in which the situation shown in FIG. 8 is achieved and the shaft 11 is moved even more closely to the bottom 3' of the wax reservoir 3.

In this manner substantially the whole quantity of wax present in the reservoir 3 can be used. For placing a new quantity of wax in the reservoir the operating members 26 are, of course, returned to their initial position in the direction opposite to the arrow P (see FIG. 1).

Figure 9:
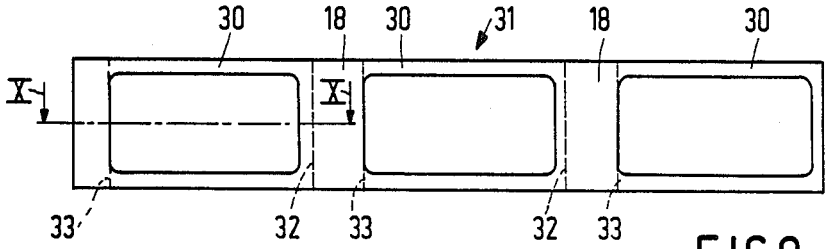
FIG. 9 shows diagrammatically several quantities of wax which are united to form a packaging unit.

FIG. 9 shows a stock of wax with which several quantities of wax 30 are combined to form a packaged unit in the form of a strip 31.

Figure 10:
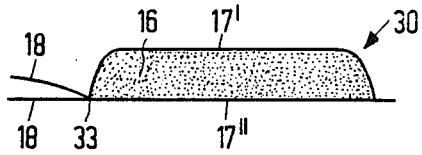
FIG. 10 is a sectional view taken on line X—X in FIG. 9 of a quantity of wax.

A single quantity of wax 30 having a portion of wax 16 as shown in FIG. 10 can be detached from the strip 31, for example, by breaking manually the perforated severing seam 32. In this manner the ends 18 are automatically formed at the foil parts 17' and 17'' (FIG. 10) which can be seized manually so that the welding seam 33 can be detached and the quantity of wax placed in the apparatus.

The quantities of wax 30, one of which is shown in FIG. 10, may, of course, also be manufactured as separate units.

What is claimed is:

1. A depilating apparatus for applying fluid wax to the skin which comprises:

a housing having an outflow aperture in a wall thereof and a reservoir to contain the wax;

means to heat the wax; and means to transport the wax from the reservoir to the outflow aperture, wherein the reservoir communicates with said outflow aperture and comprises a movable wall part which has an operating member projecting partly beyond the housing, the movable wall part being journalled in the housing so as to be rotatable and being situated opposite a bottom of the reservoir, the movable wall part comprising a first operating member which is situated near the outflow aperture and with which the wall part can be moved towards the bottom against a resilient force;

an adjusting member situated on the side of the reservoir remote from the outflow aperture and comprising a second operating member by means of which the adjusting member and the movable wall part can also be moved with respect to the bottom of the reservoir.

2. A depilating apparatus as claimed in claim 1 wherein in that the outflow aperture also forms a filling aperture for the reservoir, a wall part of the housing adjoining the outflow aperture being pivotably connected to the remaining part of the housing.

3. A depilating apparatus as claimed in claim 1 in which a foil of packaged wax is used, and wherein at the area of the outflow aperture the housing comprises a mount having an aperture which corresponds to the outflow aperture, the mount engaging, in a clamping means, ends of the foil projecting beyond the outflow aperture.

4. A depilating apparatus as claimed in claim 1 wherein the housing comprises an electric heating element.

5. A depilating apparatus as claimed in claim 4 wherein the electric heating element is constructed as a PTC element.

* * * * *